United States Patent [19]

Tomlinson

[11] 4,364,538

[45] Dec. 21, 1982

[54] ADJUSTABLE CABLE PICTURE-HANGING SYSTEM

[76] Inventor: James N. Tomlinson, 1114 Kathryn St., Boalsburg, Pa. 16827

[21] Appl. No.: 161,018

[22] Filed: Jun. 19, 1980

[51] Int. Cl.[3] ..... A47G 1/24

[52] U.S. Cl. ..... 248/495; 24/115 H

[58] Field of Search ..... 248/328, 492, 493, 495, 248/499, 505; 24/115 A, 115 H, 115 K, 129 W

[56] References Cited

U.S. PATENT DOCUMENTS

| | | | |
|---|---|---|---|
| 65,499 | 6/1867 | Miller . | |
| 237,916 | 2/1881 | Simpson | 248/493 |
| 477,522 | 6/1892 | Drayton . | |
| 496,696 | 5/1893 | Nash . | |
| 550,456 | 11/1895 | Nealy | 248/495 |
| 1,368,480 | 2/1921 | Brown | 24/115 A |
| 2,042,808 | 6/1936 | Seebeck . | |
| 2,144,963 | 1/1939 | Darlington | 24/115 H |
| 2,451,554 | 10/1948 | Hedstrom | 24/115 H |
| 3,225,403 | 12/1965 | Smith | 248/493 |
| 3,853,226 | 12/1974 | Hine et al. . | |
| 3,945,599 | 3/1976 | Spier et al. . | |

FOREIGN PATENT DOCUMENTS

| | | | |
|---|---|---|---|
| 263 | of 1891 | United Kingdom | 248/493 |

*Primary Examiner*—William H. Schultz

*Attorney, Agent, or Firm*—C. Hercus Just

[57] ABSTRACT

A picture-hanging system comprising a section of metallic picture-hanging wire cable of limited stiffness having a loop at one end to engage a mounting member, such as a screw eye, for connection to a picture frame, the other end extending through a similar mounting member and having a small locking apertureformed at the terminal portion of said other end through which an intermediate portion of said wire cable extends, whereby the length of said cable between said two attaching members may be adjusted by moving said small locking aperture along said intermediate portion of said cable and then applying tension upon the cable to effect a locking offset crimp in the cable to prevent slippage of said small locking aperture along said cable in a direction to lengthen the same between said mounting members.

10 Claims, 16 Drawing Figures

ADJUSTABLE CABLE PICTURE-HANGING SYSTEM

BACKGROUND OF THE INVENTION

For many years, pictures have been hung by utilizing conventional picture wire or wire cable composed of intertwisted individual strands of wire, which usually is sold in coils. Conventionally, such wire is employed on the backs of picture frames by passing the same through eyelets respectively connected to the rear surface of the opposite sides of a picture frame and then adjusting the length of the wire by trial and error for purposes of hanging the picture upon an appropriate hook or nail applied to a wall surface or the like. Usually adjustment is accomplished by more or less permanently twisting one end of the wire around itself with respect to one screw eye or eyelet, and then extending the other end through the opposite screw eye or eyelet and twisting that end of the wire around the intermediate portion of the wire. If the first attempt is not satisfactory, it is necessary to untwist one or the other ends of the wire and adjust the wire to a different length, retwist it, and try the same for position. This operation is time-consuming and frequently is frustrating. Further, especially in galleries or large displays of a number of pictures, it has been customary to hang said pictures from a molding adjacent the ceiling to which appropriate hooks are attached and the wires are formed with a loop at one end which is passed over the hook and then extended downward for connection to a nail or eyelet, screw eye or otherwise attached to the picture frame, two such wires or cables usually being required for each picture. Appropriate adjustment of the end of the wire attached to the picture frame also is necessary, usually by trial and error, and includes twisting and untwisting the lower end of the wire with respect to the attachment means on the picture frame until the desired level of the picture is achieved.

Adjustment of the length of tying cords or suspension lines of various types by readily adjustable means has been the subject of prior activity and various examples of the adjustability of various lengths of flexible cords and the like comprise the subject matter of the following U.S. Patents:

U.S. Pat. No. 65,499: Miller June 4, 1867
U.S. Pat. No. 477,522: Drayton June 21, 1892
U.S. Pat. No. 496,696: Nash May 2, 1893
U.S. Pat. No. 2,042,808: Seebeck June 2, 1936
U.S. Pat. No. 2,144,963: Darlington Jan. 24, 1939

None of the foregoing patents suggest the application of quickly operable adjustable means for the length of so-called picture wire or cable. However, there have been attempts in other directions to provide means by which pictures or wall-display devices might be supported by adjustable means and examples of at least several types of such means comprise the subject matter of prior U.S. Pat. Nos. 3,853,226 to Hine, dated Dec. 10, 1974 and 3,945,599 to Spier et al, dated Mar. 23, 1976.

Neither of the foregoing patents employ picture wire or cable and the established use of such material for hanging pictures or the like on wall surfaces or otherwise still remains very popular and it is the purpose of the present invention to provide simple and appropriate adjustable means for desired lengths of picture wire or cable and the basic principles of the present invention applied to such wire or cable are not found in the prior art, details of the same being as follows:

SUMMARY OF THE INVENTION

It is the principal object of the present invention to provide picture-hanging wire or cable in various lengths and arranged in commercial form for application to picture frames and/or supporting means, such as hooks, nails or otherwise, without the use of tools to require the desired adjustment of the length of such wire or cable.

It is another object of the invention to provide such length-adjustable means for picture hanger wire or cable by providing one end of a predetermined length of such wire or cable with a small locking aperture, such as a loop of the cable, which has an opening only slightly larger than the diameter of the wire or cable and through which said wire or cable passes incident to forming a larger loop which extends through a mounting member, such as a screw eye or eyelet, and the opposite end of the predetermined length of wire or cable is formed into another loop for connection to another similar mounting member, whereby the length of the cable extending between said mounting members can be precisely adjusted, without the use of tools, simply by moving the small locking aperture along the intermediate portion of the wire or cable between the mounting means until the desired effective length is achieved, and then place tension upon said wire or cable to cause an offset locking crimp to be formed in the portion of cable extending through said small locking aperture.

Further objects of the invention are to provide said locking aperture in or upon said one end of the cable in a number of different embodiments of means and/or members affixed to said one end of said cable and through which an intermediate portion of the cable extends for adjustment of the effective length of the cable between the mounting members upon a picture frame or otherwise, certain of said embodiments including supplemental means to facilitate or enhance the locking of said effective length by forming an offset crimp in the cable as aforesaid.

Still other objects of the invention are to provide a range of different lengths of hanger wire or cable, in which one end thereof is provided with a permanent loop formed by a swedged sleeve-like member and the opposite end is provided with said aforementioned small loop which is secured by another sleeve-like member swedged into locking engagement therewith, either with or without supplemental means to facilitate the crimping action, whereby the effective length of wire or cable extending between a pair of mounting members respectively affixed to opposite sides of a picture or between one side of a picture and a suspending hook from a horizontal molding or the like may be manufactured and sold either as a completed product or a set of required components and, depending upon the length selected for a particular picture to be supported thereby, said cable may be arranged in a variety of different patterns and configurations, either singly or in conjunction with other similar lengths of wire or cable, whereby pictures may be suspended from one or more hooks, nails or screws, respectively affixed to a wall surface or horizontal molding or the like and the relative inconspicuous nature of the wire or cable is such that pictures may be supported readily one above the other by extending such wire or cable downwardly behind an upper picture, whereby no unsightly aspect is present.

Details of the foregoing objects and of the invention, as well as other objects thereof, are set forth in the following specification and illustrated in the accompanying drawings comprising a part thereof.

BRIEF DESCRIPTION OF THE DRAWINGS

FIG. 16 being as viewed on line 16—16 of FIG. 15.

DETAILED DESCRIPTION OF THE PREFERRED EMBODIMENT

Figure 1:
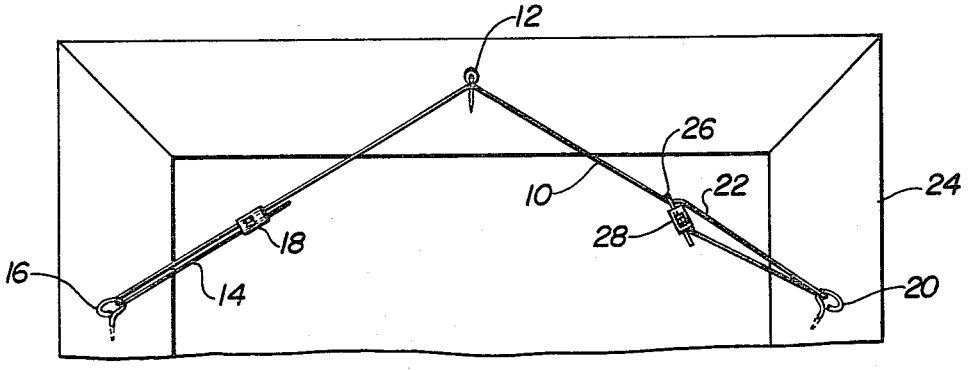
FIG. 1 is an exemplary elevation of an adjustable wire or cable picture-hanging system embodying the principles of the present invention and illustrated as being attached to a fragmentarily illustrated section of a picture frame.

The present invention pertains to picture wire or cable of conventional type for supporting pictures and similar wall decorations and composed of a plurality of strands of wire which are intertwisted or plaited to a limited extent to maintain a stable assembly thereof which has limited stiffness. Referring to FIG. 1, a predetermined length of picture wire or cable 10 is illustrated as being supported upon an exemplary nail 12 driven into a wall surface and representative of a number of different types of supporting means, such as hooks, screws, or otherwise, by which pictures are frequently held upon a wall surface. One end of the wire or cable 10 is formed into a first elongated loop 14 of reasonable length, such as one inch, or any other desired size and to which is connected a mounting member, such as a screw eye 16, which may be closed or partially open to receive said loop. The end portion of the cable which forms the loop 14 is connected to an intermediate location of the cable preferably by a small sleeve-like member 18 which may be tubular and the same is swedged into firm engagement with the portions of the cable enclosed therein to stabilize the loop 14, as shown especially in FIGS. 1–5.

The opposite end of the adjustable wire or cable extends through or otherwise engages another mounting member 20, such as a screw eye, and forms a second loop 22 of adjustable length for purposes of establishing a desired overall length of the wire or cable 10 between the pair of mounting members 16 and 20, which respectively are attached to opposite sides of an exemplary picture frame 24, illustrated in FIG. 1. The adjustability of the length of the wire or cable 10 is effected without the use of tools of any kind by means of a variety of embodiments of mechanical locking systems, respectively illustrated in FIGS. 3–5 and 13–16. A plurality of exemplary arrangement of wires or cables for supporting pictures and the like also are additionally shown in FIGS. 6–10.

Figure 4:
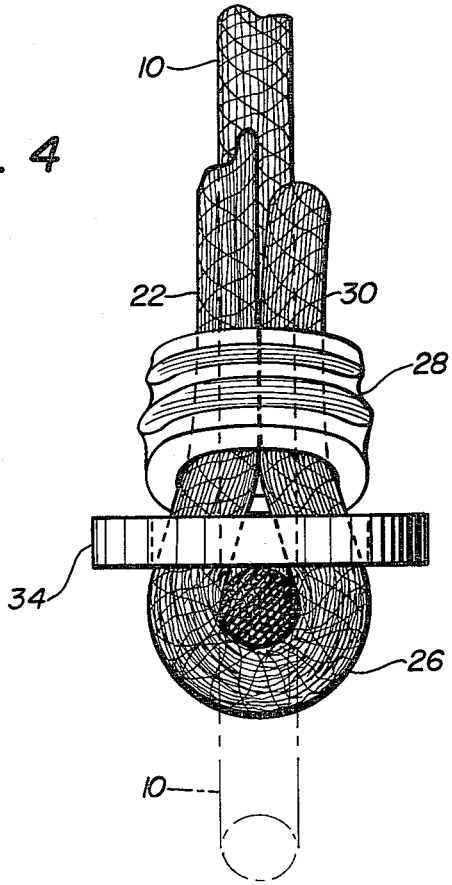
FIG. 4 is a fragmentary sectional elevation of the portion of the structure shown in FIG. 3, as seen on the line 4—4 thereof and further enlarged in scale over that of FIG. 3.

The terminal end portion of the wire or cable which forms the loop 22 is provided with means having a small locking aperture 26, the diameter of which preferably is only slightly greater than the diameter of the wire or cable 10 passing therethrough, as best shown in FIG. 4. The embodiment of locking aperture shown in FIGS. 3–5 comprises a small loop formed from the cable 10 which is bent upon itself into a loop which is secured in permanent arrangement by another sleeve-like member 28, through which two portions of the wire or cable extend, one of which is the terminal end 30, as shown in FIG. 4, and the other comprising part of the loop 22.

As in regard to the sleeve-like member 18, the corresponding member 28 may originally be tubular or otherwise, as long as it surrounds and permanently connects the portions 22 and 30 of the cable to firmly establish the small locking aperture or loop 26 for the purpose described below.

The embodiment of locking aperture comprising small locking loop 26 operates adjustably in conjunction with an intermediate portion of the metal wire or cable 10 to form an offset locking crimp 32 in the wire or cable, especially when tension is placed upon opposite ends of the same as when said opposite ends respectively are secured to the mounting members 16 and 20 when applied to a picture frame, for example. The establishment of such offset locking crimp also is further facilitated if a small transversely extending washer 34 is mounted between the small locking loop 26 and the adjacent end of the sleeve-like member 28. However, it is to be understood that even without the use of the washer 34, an effective offset locking crimp 32, nevertheless, will be formed in the wire or cable 10 under the circumstances described above, as clearly shown in FIG. 5 in exemplary manner, and such crimp will be of a self-maintaining nature even when the cable is relaxed as, for example, when disconnected from a supporting member, such as the exemplary nail 12, shown in FIG. 1, due to the somewhat stiff inherent nature of the cable.

Figure 5:
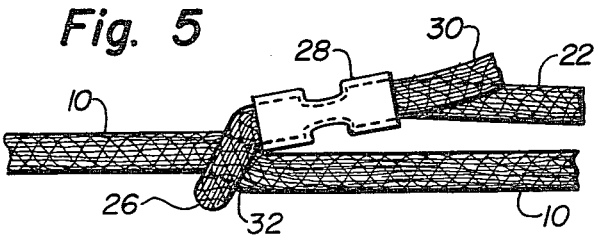
FIG. 5 is a view similar to FIG. 4 but showing a further embodiment of locking mechanism.
Figure 6:
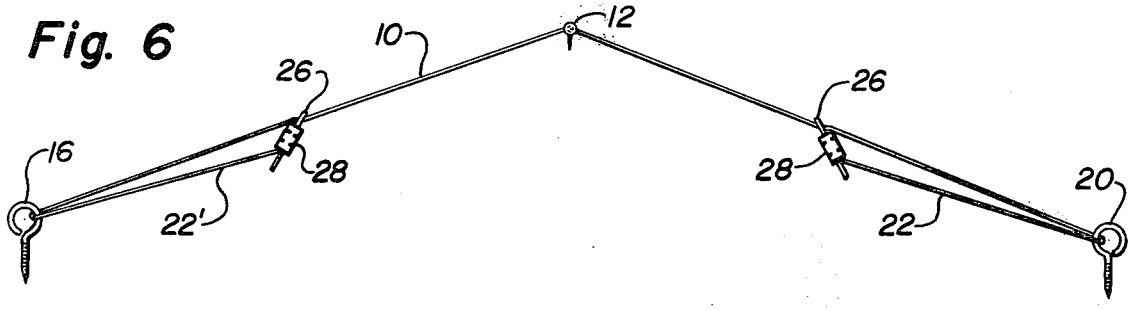
FIGS. 6 and 7, respectively, show different arrangements of various predetermined lengths of picture wire or cable which include the invention and are applicable to various sizes of picture frames.
Figure 7:
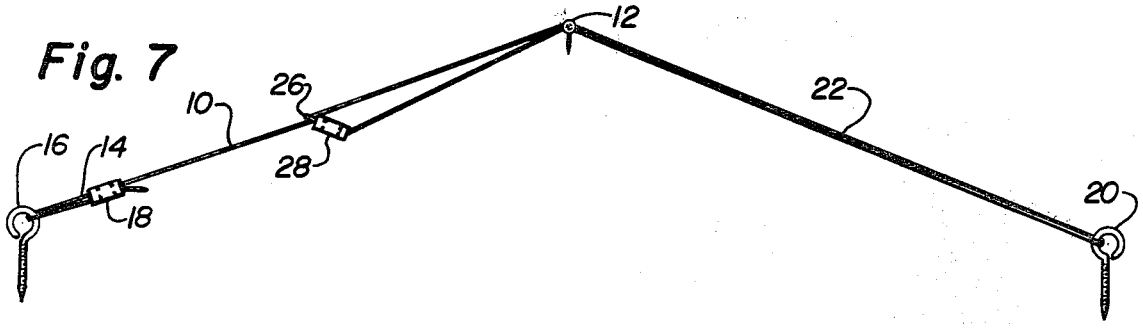
Figure 8:
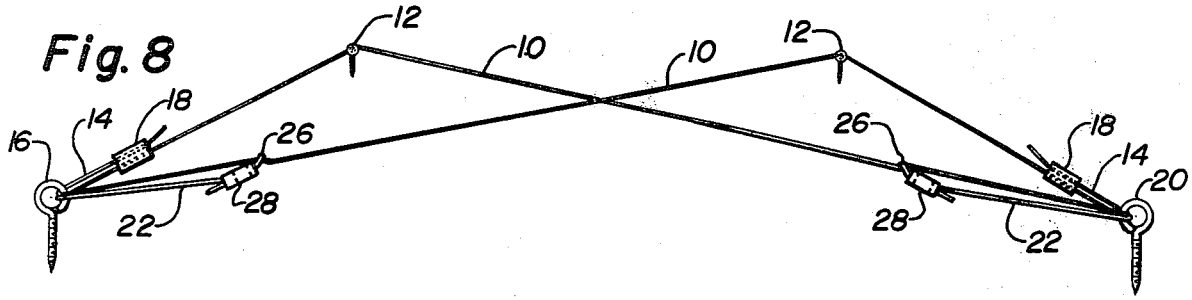
FIG. 8 is a view similar to FIGS. 6 and 7, but showing the use of a pair of cables with two hanging means.

Referring to FIGS. 6, 7 and 8, it will be seen that several variations of use of the cable system of the invention are possible. For example, in FIG. 6, both ends of the wire or cable 10 may be provided with the adjustable locking loops 22, with which the small loops 26 are respectively associated, whereby the use of a permanent loop 14 is eliminated in lieu of a second adjustable loop 22'. In FIG. 7, a longer cable or wire 10 than that illustrated in FIGS. 1 and 5 is shown in which an extra long adjustable loop 22 is shown as extending over the supporting member 12, under circumstances where, for example, a longer length of the wire or cable 10 is available and it is not desired to cut or otherwise shorten the same.

FIG. 8 also illustrates a further adaptation of the invention in which a pair of supporting members, such as exemplary nails 12, are shown affixed to the wall upon which a relatively wide picture is to be mounted, and under which circumstances, a pair of the picture wire or cables 10 are used in supplementary conjunction with each other, and in so doing, the loops 14 on each respectively engage mounting members 16 and 20 and the adjustable loops 22 thereof respectively engage the opposite mounting member, as clearly shown in FIG. 8. The loops 22 are adjusted in length by adjustment of the locking loops 26 upon the intermediate portion of the cable 10 to which it is attached. This arrangement of cables provides an effective steadying arrangement for very wide or long narrow pictures or mirrors, especially when the latter are hung sideways.

Figure 2:
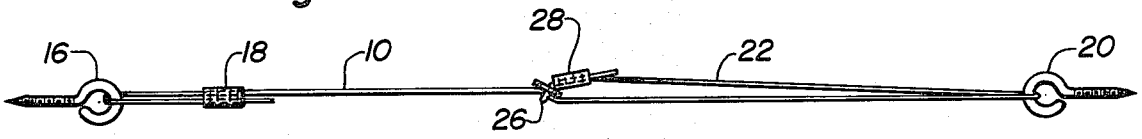
FIG. 2 is a plan view of a picture hanger wire or cable illustrated in the preferred form thereof and including exemplary mounting members in the form of screw eyes.
Figure 3:
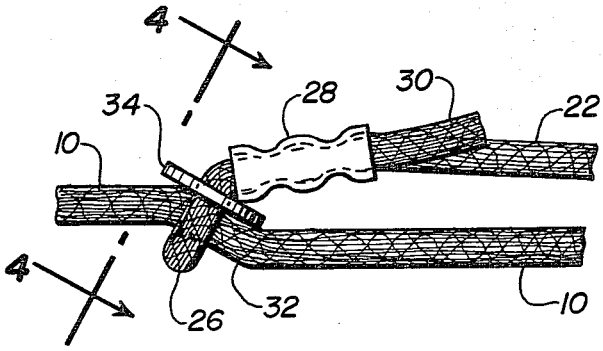
FIG. 3 is a fragmentary enlarged plan view of one embodiment of mechanism applied to the cable by which adjustment of the length of the cable between a pair of mounting members may be achieved.
Figure 9:
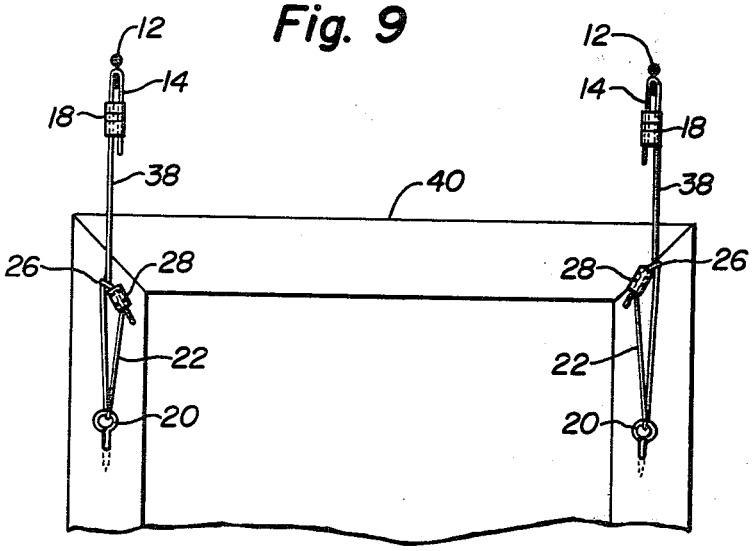
FIG. 9 illustrates still another arrangement of the invention utilizing a pair of similar adjustable wire or cable units applied respectively to the opposite sides of a fragmentarily illustrated picture frame, shown in phantom.

In FIG. 9, a further exemplary illustration of a pair of relatively straight, elongated wire or cable units 38, which, as illustrated, may be either relatively short or very long versions of the units shown in FIGS. 1 and 2, the same respectively being attached to opposite sides of an exemplary picture frame 40, shown fragmentarily.

Figure 10:
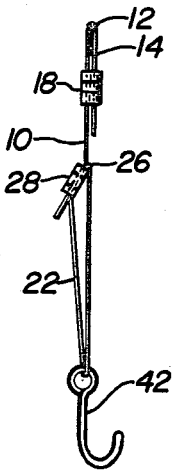
FIG. 10 is a plan view of a slightly different modification of a wire or cable embodying the invention, including a hook for use in vertical suspension arrangements, either singly or in conjunction with additional similar wires or cables.

In FIG. 10, an exemplary picture-hanging unit embodying the invention of the type shown in FIGS. 1 and 2, is shown disposed vertically for purposes of supporting on the lower end thereof a hook 42 for purposes of supporting any desired object in vertically adjustable manner.

Figure 11:
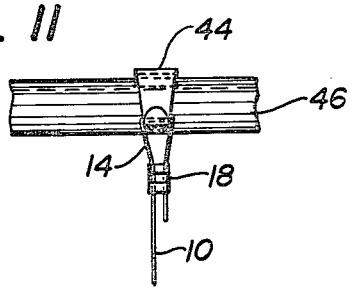
FIG. 11 is a fragmentary illustration of another embodiment of support for a cable, such as shown in FIGS. 10 or 11, in conjunction with a fragmentarily illustrated section of molding.
Figure 12:
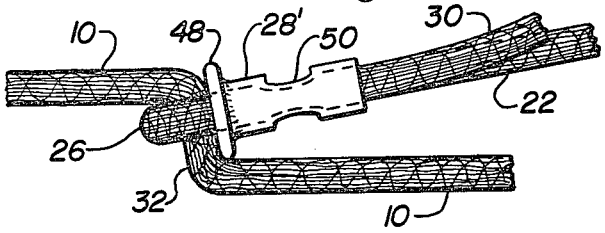
FIG. 12 is another fragmentary view similar to FIGS. 4 and 5, but showing still another embodiment of locking mechanism.

In FIG. 11, a fragmentary illustration shows the manner in which the loop 14 of a cable unit 10 may be secured to a conventional hook 44 which may be connected to a suitable horizontal molding 46 on a wall for support of the cable 10.

Possible additional variations in the formation of the locking mechanism for the cable units 10 have been devised as respectively shown in FIGS. 12–16, to which attention is directed. In the embodiment illustrated in FIG. 12, the same actually comprises a modification for variation of the arrangement shown in FIGS. 3 and 4, but in the variation of FIG. 12, the sleeve-like member 28' has the end thereof nearest the small locking loop 26 provided with a radially extending flange 48 integral with the sleeve-like member 28' and is adapted to engage the cable 10 to form the offset locking crimp 32 more effectively than that provided by the locking loop 26, for example, of the embodiment shown in FIG. 5. As in the other embodiments, the sleeve-like member 28' is swedged at 50 to securely connect the terminal end 30 of cable 10 to the adjacent portion of the adjustable loop 22 which forms the small locking loop 26.

Figure 13:
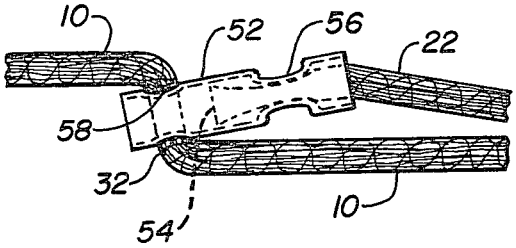
FIGS. 13 and 14 are additional fragmentary views similar to FIGS. 4, 5 and 12, but showing still further embodiments of locking mechanism including the principles of the invention.
Figure 14:
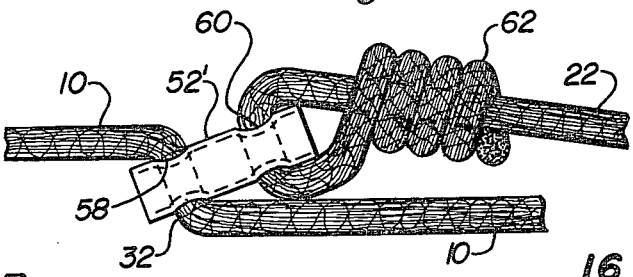

FIGS. 13 and 14 show a further embodiment of an element to form the small locking aperture, illustrated respectively in two different forms. In FIG. 13, the form of locking means comprises a short locking member 52, which preferably is tubular and one end thereof receives the terminal end 54 of the portion of the cable 10 which forms the adjustable loop 22 and said terminal end is fixedly secured to the member 52 by swedging the same at 56. The opposite end portion of the member 52 is provided with an aperture 58 extending transversely therethrough for reception of the cable 10 in an manner to form the offset locking crimp 32 when the opposite ends of the cable unit are placed under tension, as described hereinabove with the preceding embodiments. As in said other embodiments, the diameter of the aperture 58 is only slightly larger than that of the cable 10 for the reasons stated above relative to said preceding embodiment.

Referring to FIG. 14, the embodiment therein illustrated includes a short locking member 52', which may either be tubular or solid and in one end portion thereof a transverse aperture 58 is formed similar to that shown in the embodiment of FIG. 13. The opposite end of the member 52' also is provided with an additional transverse aperture 60 through which the terminal end portion of the end of the cable 10 which forms the adjustable loop 22 extends and the terminal end portion 62 thereof is coiled around the body of the cable portion forming the adjustable loop 22, as clearly shown in FIG. 14. If desired, rather than the member 52' being tubular, it may be solid.

Figure 15:
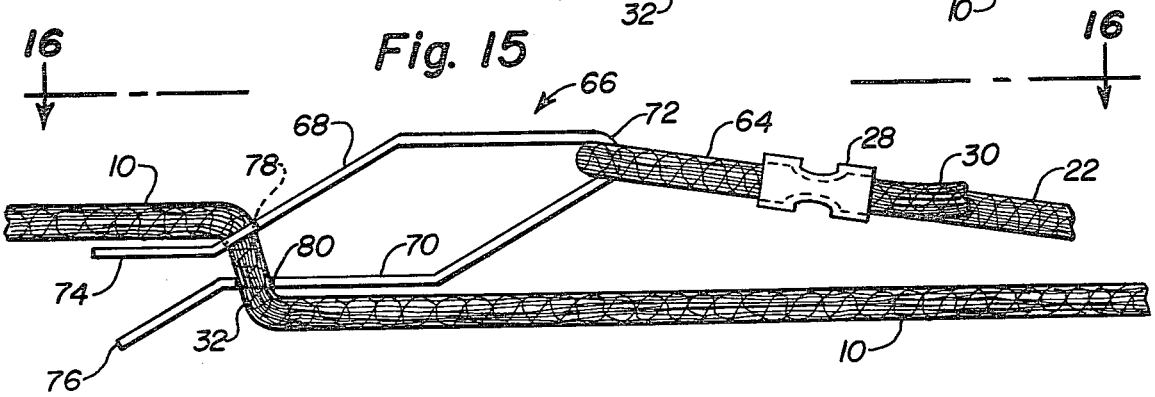
FIGS. 15 and 16, respectively, are fragmentary side elevation and plan views of one additional embodiment of locking mechanism, including the principles of the invention.
Figure 16:
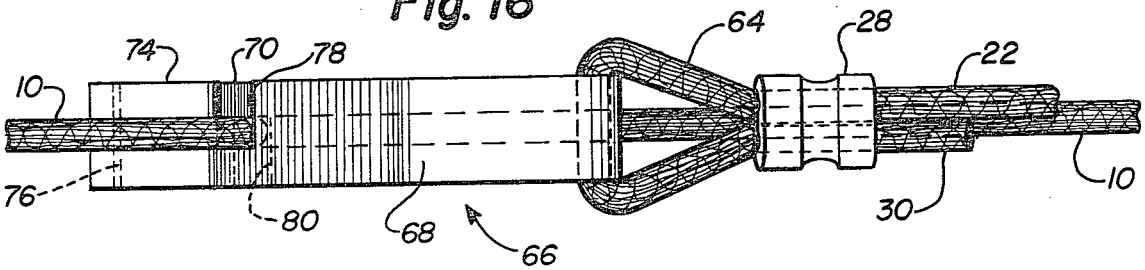

One further embodiment of locking mechanism is illustrated in FIGS. 15 and 16, respectively, in side elevation and plan view. In this embodiment, the terminal end of the cable 10 which forms the adjustable loop 22 is formed into an additional loop 64, which somewhat corresponds to the locking loop 26 of certain of the preceding embodiments but instead, the loop 64 is used as a connecting means to attach a separate tweezer-like element 66 thereto, which is provided with a plurality of locking apertures through which the cable 10 extends to form an offset locking crimp 32 therein. The tweezer-like element 66 is composed of a pair of relatively rigid leaves 68 and 70, similar ends of said leaves being connected at 72 by a sharp bend which is encompassed by the additional loop 64 of the adjustable loop 22 of cable 10. The opposite end portions 74 and 76, respectively, of the leaves 68 and 70, flare outwardly with respect to each other to facilitate the disposition of the cable 10 between the outer portions of the leaves 68 and 70 for purposes of said cable being received respectively within transverse slots 78 and 80 respectively formed in the leaves 68 and 70, said slots actually comprising locking apertures, the width of which are only slightly greater than the diameter of the cable 10. Such arrangement amply forms the offset locking crimp 32 in the cable 10. If desired, rather than use both of the leaves 68 and 70, a single leaf suitably connected at one end to the loop 64 may be used and the single transverse slot formed therein will be adequate to form the offset locking crimp in the cable 10 when tension is placed upon opposite ends thereof. However, by providing a pair of the leaves with the transverse slots 78 and 80 respectively extending thereinto from opposite side edges of the leaves, a more effective gripping of the cable 10 is afforded.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. An adjustable picture-hanging system comprising a length of metal picture-hanging wire cable having one end portion formed into a first loop connectable to a mounting member on a picture frame and the opposite end of said cable being provided with a small locking aperture having a cross-sectional dimension only slightly greater than that of said cable and through which an intermediate portion of said cable extends and substantially fills said aperture to form an adjustable second loop for connection to another mounting member on a picture frame, the effective length of said cable between said mounting members being adjustable by moving said intermediate portion of said cable through said small locking aperture and then tensioning said cable between said mounting members, whereby said small locking aperture engages the cable portion passing therethrough and bends it a limited extent into an offset locking crimp in said cable operable to prevent slippage of said cable relative to said locking aperture in a direction to lengthen the same between said mounting members.

2. The picture-hanging system according to claim 1 in which said first loop comprises an end portion of said cable bent into a loop configuration and disposed in parallel relationship along said cable and secured thereto in such formation by a sleeve-like member surrounding and swedged into locking engagement with the cable portions extending therethrough.

3. The picture-hanging system according to claim 2 in which said small locking aperture comprises a small locking loop formed by said opposite end of said cable being bent upon itself and secured in such shape by another sleeve surrounding overlying parallel portions of said cable and swedged into firm locking engagement therewith.

4. The picture-hanging system according to claim 3 further including a washer of limited greater diameter than said sleeve mounted between said small locking loop and said sleeve which secures said small locking loop and operable to enhance the crimping and locking effect of said small locking loop.

5. The picture-hanging system according to claim 3 in which the end of said another sleeve nearest said small locking loop terminates in a flange extending radially a limited distance beyond said sleeve and is operable to engage said intermediate portion of said cable adjacent said small locking loop to enhance the crimping and locking effect thereof.

6. The picture-hanging system according to claim 1 in which said small locking aperture comprises a short locking member having one end fixedly secured to said opposite end of said cable and the opposite end portion of said locking member having an aperture extending transversely therethrough and through which said intermediate portion of said cable extends as aforesaid, the diameter of said aperture being only slightly greater than that of said cable.

7. The picture-hanging system according to claim 6 in which said short locking member comprises a tube receiving in said one end thereof said opposite end of said cable and swedged against said cable, and said opposite end portion of said tube having said aperture extending transversely therethrough.

8. The picture-hanging system according to claim 6 in which said short locking member also has a second aperture extending transversely through said one end thereof and said opposite end of said cable being looped through said second aperture and the terminal end portion being secured to said cable adjacent said second aperture.

9. The picture-hanging system according to claim 1 in which said small locking aperture comprises a rigid member of limited width fixed at one end to said opposite end of said cable and the opposite end portion thereof having a transverse slot extending thereinto from one edge, said slot having a width only slightly greater than the diameter of said cable and a depth at least greater than the diameter of said cable and receiving said intermediate portion of said cable to form a locking offset crimp in said cable for the aforesaid purposes.

10. The picture-hanging system according to claim 9 in which said rigid member comprises two similar leaves respectively extending tweezer-like and connected at the connected ends of said member to said opposite end of said cable and said leaves each have transverse slots extending respectively into opposite edges of said leaves at adjacent locations therein and of the aforesaid width and depth to receive said intermediate portion of said cable for the aforesaid purposes respectively to form a locking offset crimp in said cable and also facilitate the connection of said rigid members in receiving engagement with said intermediate portion of said cable.

* * * * *